United States Patent [19]

Teich et al.

[11] Patent Number: 4,785,285

[45] Date of Patent: Nov. 15, 1988

[54] PARALLEL BUS ALARM SYSTEM

[75] Inventors: Rudor M. Teich, South Orange; Keith Guillaume, Edison; Ram Shalvi, Teaneck, all of N.J.

[73] Assignee: Tracer Electronics, Inc., Bloomfield, N.J.

[21] Appl. No.: 27,311

[22] Filed: Mar. 18, 1987

[51] Int. Cl.[4] ..... G08B 26/00

[52] U.S. Cl. ..... 340/518; 340/505; 340/870.16; 340/511

[58] Field of Search ..... 340/518, 505, 514, 825.06, 340/825.07, 825.08, 825.09, 511, 825.1, 510, 825.54, 870.16, 870.21

[56] References Cited

U.S. PATENT DOCUMENTS 4,555,695 11/1985 Machida et al. ..... 340/505

4,613,848 9/1986 Watkins ..... 340/505

*Primary Examiner*—Donnie L. Crosland

*Attorney, Agent, or Firm*—Gottlieb, Rackman & Reisman

[57] ABSTRACT

A parallel bus alarm system in which address signals are represented by successive voltage steps, and responses are represented by current increments. Each alarm element, in response to its addressing, controls a variable current increment to flow in the bus, the magnitude of the current increment being a function of an associated analog measurement to be reported. Each alarm element also causes a predetermined current increment to flow in the bus in response to a condition arising which requires reporting, the total current change thus being directly proportional to the number of alarm indications.

9 Claims, 3 Drawing Sheets

PARALLEL BUS ALARM SYSTEM

This invention relates to alarm systems, and more particularly to parallel bus alarm systems.

In our applications Ser. No. 838,595, filed on Mar. 11, 1986 and entitled "Single-Wire Loop Alarm System," and Ser. No. 898,099, filed on Aug. 20, 1986 and entitled "Improved Single-Wire Loop Alarm System," which applications are hereby incorporated by reference, there are disclosed alarm systems for use with conventional-type single-wire loops. By placing a unique identification module across each switch in the loop, it is possible to determine during a polling sequence which switches are open. In order to retrofit an existing system, all that is required, in addition to placing an identification module across any switch which must be identified when open, is to place a central control in the existing system between the installed alarm panel and the two ends of the single-wire loop. The identification modules are not self-powered. As long as an alarm switch is closed, no current flows through the associated identification module since it is shorted by the normally-closed switch. However, when the switch opens current is no longer by-passed and it flows through the module; the loop current now powers the module.

In the system disclosed in our first application, when an alarm switch opens and the associated identification module is powered, a voltage drop, 5 volts in one example, appears across the inputs of the module. It is the powering of the identification module which is reflected as a changed loop characteristic—in this case, an increased impedance. The central control causes a constant current to flow through the loop, derived from a 35-volt supply. Because there is now a drop of 5 volts across the open switch, there is an increased potential drop across the two ends of the loop at the control panel. It is this changed potential which informs the central control that a switch is open. Because a 35-volt supply is used, and there is a 5-volt drop across each switch when it is open, the system is capable of identifying the number of open switches, up to 6.

The central control, which includes what is called a tracer panel, initiates a polling cycle by pulsing the loop. The loop current is caused to momentarily cease for 1 millisecond, at 2-millisecond intervals. The total number of current cessations in this manner represents the address of the module being interrogated. Only when the total count in any interrogation cycle equals the address of a module does it take action, provided that its associated switch is open and it is powered in the first place. The module changes the loop characteristic at this time, and causes the voltage drop across the switch to be reduced from 5 volts to 3 volts. The momentary change which is sensed at the tracer panel is an indication that the alarm switch now being addressed is open.

The system disclosed in our first application, while efficacious, may be subject to erroneous operation in the presence of noise. One problem is that noise can cause an erroneous indication unless the signal being monitored is integrated so as to smooth out transients. But use of a filter slows down the response time and could severely affect the number of switches which could be included in the system if polling speed is important. The problem is solved in the system disclosed in our second application by providing two sense channels—one with an integrator and one without. The slow channel is used for measurements of loop voltage and all non-time critical loop monitoring functions. The fast channel is used to poll the modules once it is determined that an alarm condition exists.

Another problem with our first system is that filtering (integration) does not guard against slow-varying noise. An alarm condition is supposed to be sensed only when an open switch causes its associated module to introduce an impedance in the loop; the constant current which flows through this impedance causes a voltage drop to appear across the loop. Unfortunately, even slow-varying noise can do the same thing. This problem is solved in our second system by verifying the source of the sensed voltage drop. The loop current is doubled in one embodiment of the invention immediately after an alarm condition is sensed. If the voltage drop also doubles, it is an indication that the source of the drop is indeed resistive, an open switch. If the voltage drop does not double, it is an indication that noise could be appearing on the loop. In general, the verification scheme entails changing the loop current and checking whether a linear function characterizes the change in loop voltage.

A third problem in our first system arises during polling of the switches. A programmable comparator is used to sense a responding module (which causes its 5-volt drop to momentarily reduce to a 3-volt drop). A threshold level is set in the comparator and a test is performed to see whether the responding module causes a voltage change in the loop which is sufficient to cause the comparator threshold to be crossed. Unfortunately, noise can also cause a "crossing." The solution to this problem, incorporated in our second system, is to check that the changed loop voltage is within a "window," not merely that it crosses a threshold at one limit of the window. What makes the scheme practical is the use of a hardware-controlled offset for the comparator; a software approach, used in the other measurements taken by the system, would slow things down so much that use of a window would not be practical. The noise rejection is enhanced by the use of an adaptive reference level and pre-pulsing of the loop to compensate for parasitic capacitances.

The fundamental shortcoming of all serial systems such as those disclosed in our two above-identified applications is that there is a relatively low limit to the number of units which may be placed on the same serial line, if the system must be able to identify particular switches which are operated when many of them are in fact operated. This is because each operated switch results in an increased voltage drop across it, and the voltage drops of many units connected in series can quickly add up to the supply potential. The advantage of conventional parallel systems, in which multiple module/switches are connected in parallel across the two conductors of a line, is that the control system can communicate with many more units which are active at the same time (assuming the same potential difference across the two ends of the line, be it serial or parallel). That is because in the case of a parallel system, all units are powered in parallel and thus their voltages need not be added up. In the case of fire/smoke alarms, there is an even greater impetus for providing a parallel system because traditionally that is the configuration which is used.

It is therefore an object of our present invention to provide a reliable parallel bus alarm system, one which is ideally suited for fire/smoke alarms but which is also adaptable to burglar and other alarm applications.

In prior art parallel systems, the alarm units are generally placed in parallel across the line. A potential is applied across the two conductors in the line and if one of the alarm elements operates, it allows an increased current to flow. An increased current is an indication that there is at least one alarm condition. If there are two or more simultaneous alarm conditions, in some systems a still larger current may flow. However, it has not been practical in the past to interrogate the individual elements to determine which of them are on. All that it has been possible to do in practical systems which have been marketed is to determine whether the current flowing in the line exceeds a threshold, thereby representing that one or more alarm conditions exist. In order to identify particular alarm conditions, it has been necessary to provide a separate line for each alarm unit.

It is a general object of our invention to provide a parallel bus alarm system in which the individual alarm units can be interrogated and in which all of the many dozens of units which are simultaneously operated can be identified.

In our earlier systems, the serial loop was driven by a constant current source. The total voltage drop across the loop represented the number of switches which were open. In the system of the present invention, a parallel bus alarm configuration, the loop is driven from a constant voltage source and the loop current is monitored. Any alarm unit which is on causes the total current in the loop to be increased by a fixed increment. By monitoring the total current, it is possible to determine the number of alarm units which are on.

The loop is driven by a source with a low impedance. For one thing, the loop is an antenna and a low source impedance reduces the effects of noise. More important, the address signalling is controlled by cycling the potential across the bus, while the response of each identification module is a current step. Were that current step to affect the loop voltage, the other identification modules might interpret such a change in loop voltage as an addressing signal. By keeping the loop source impedance low, a change in loop current has little effect on the loop voltage, and thus a report by a module of its status cannot result in the erroneous clocking of the other modules.

The individual identification modules are scanned by pulsing the line so that the potential drop across all of the units in parallel varies between two fixed levels. The modules themselves are of the type disclosed in our above-identified applications, and the clock pulses advance a count in each module; when a module recognizes the current count as representing its own address, it responds to the query. The module responds by causing the current through it to increase. If the increase exceeds a threshold value, it is an indication of an alarm condition. The increase can also represent an analog value, for example, the dust level in a smoke detector even if an alarm condition does not exist, and the system can measure the change in current to determine the analog measurement associated with the module which is responding.

Each switch/identification module controls two different kinds of current change in the loop. During quiescent conditions when there is no alarm, a quiescent current flows through the loop. If any unit enters an alarm condition, it causes a predetermined increment of current to flow. By measuring the total change in current, the system can determine precisely how many alarm conditions exist. It is only during the interrogation of a particular unit—to the exclusion of all others—that it causes a current change which is proportional to the measurement to be transmitted. The change in the total current level during that scanning time slot is a measure of the analog parameter of concern for that particular unit. Without the two different types of response of each identification module, it would not be possible to determine how many alarm conditions exist due to the fact that the analog levels even for units which represent alarm conditions may vary.

One of the most important advantages of the technique of our invention is that a single analog-todigital converter in the control unit is all that is required to determine the magnitude of any analog measurement reported by an identification module. In the prior art, where analog data is returned via a multiplexed system, an analog-to-digital converter has been incorporated in each identification module, with a digital signal being transmitted over the line to the control unit. It is much cheaper to send back an analog signal and to avoid conversion in the individual modules. Some prior art units convert the analog signals to be reported to a pulse width rather than a series of bit signals, but conversion circuitry is still required, adding considerable cost to each alarm unit. Illustrative prior art patents are U.S. Pat. Nos. 3,585,596 and 4,435,706. Also, because data is sent back in analog form, a single pulse of short duration, for example, 500 microseconds, conveys the same information as would a stream of perhaps six binary pulses. Our method is also faster than a pulse-width modulation scheme, the latter scheme requiring a relatively long response time in the case of a wide pulse (representing a large analog value).

Further objects, features and advantages of our invention will become apparent upon consideration of the following detailed description in conjunction with the drawing, in which.

Figure 1:
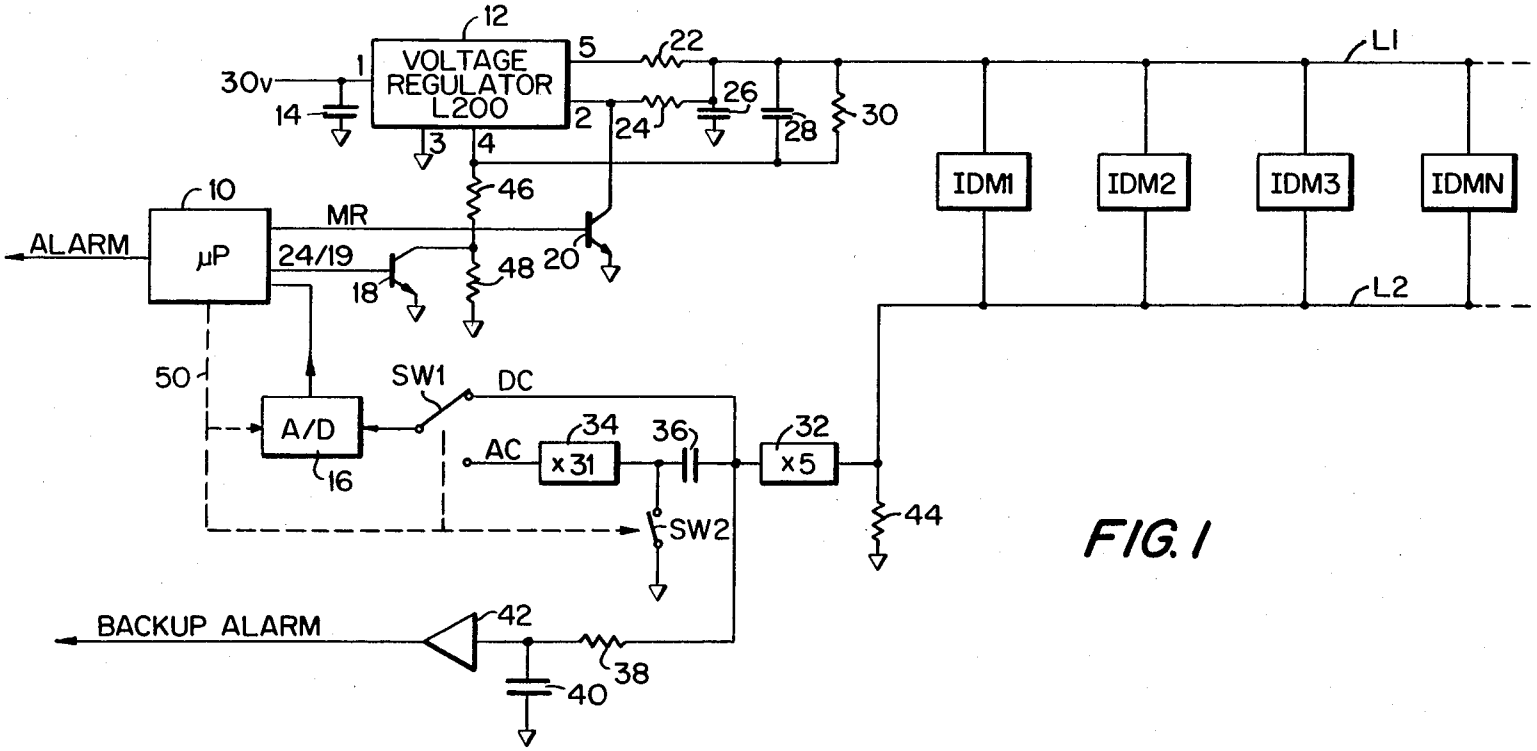
FIG. 1 depicts the illustrative embodiment of our invention.

The overall system is shown in FIG. 1. All activities are under control of microprocessor 10. The microprocessor has relatively few points of interface with the system. The microprocessor reads the analog-to-digital converter 16; the input represents the magnitude of an analog level applied to the input of the converter by switch SW1. The two possible switch positions are labelled DC and AC, although even when an AC measurement is taken it is of a steady level. Line 50 symbolically depicts the microprocessor control over switch SW1, another switch SW2, and converter 16.

Figure 2:
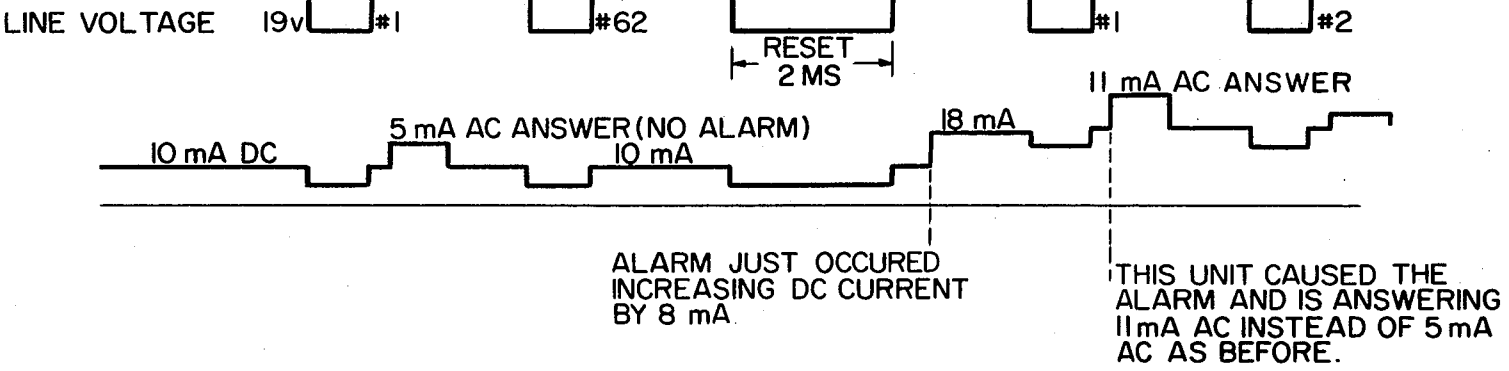
FIG. 2 depicts typical voltage and current waveforms which appear on the system bus.

The microprocessor has two outputs for controlling the bus voltage. When the MR line goes high, transistor 20 turns on and, as will be described, all of the identification modules on the line are reset; the MR signal is a master reset. The 24/19 line controls the turning on and off of transistor 18. This, in turn, causes the voltage across conductors L1 and L2 to vary between 24 volts and 19 volts as shown in FIG. 2. A third output of the microprocessor represents an alarm signal. As disclosed in the above-identified applications, the microprocessor may identify particular switches which are in an alarm condition.

The interrogating voltage waveform of FIG. 2 is derived by voltage regulator 12, a standard L200 integrated circuit manufactured by the SGS Group. A 30 volt potential is applied to pin 1, across filter capacitor 14. The output potential appears at pin 5. Resistor 22 aas a value of 1 ohm. It is provided as a standard protection feature in order to limit the current supplied by the regulator to 700 milliamperes, although it is not expected that the current will exceed 500 milliamperes in actual practice. If the potential across the resistor rises above 0.7 volts, the potential difference between pins 2 and 5 causes the regulator to decrease the current. Resistor 24 has a value of 1 kilohm. It is provided in order that a low potential applied directly to pin 2 through transistor 20 can completely turn the regulator off, with the line potential dropping to zero. In the event a transient on the line causes an identification module to lock up (the identification modules are preferably made of CMOS circuits, and CMOS circuits can lock up), the microprocessor can determine the fact if the identification module does not respond to a query. The microprocessor can then pulse the MR line so that power is removed from all of the identification modules. They all reset. When the MR output of the microprocessor goes low again, a powering potential is applied once again to the identification modules.

The voltage regulator is designed so that pin 4 seeks a 2.77-volt level. The potential at pin 4 is a function of the potential of conductor L1, but the voltage is divided down by resistor 30 on the one hand, and resistors 46 and 48 on the other. However, resistor 46 can be shorted to ground through transistor 18 if the 24/19 bit output of the microprocessor is high. It is in this way that the voltage regulator is controlled by the microprocessor so that the potential on conductor L1 switches between 24 volts and 19 volts. In the case of a burglar alarm system, levels of 6 volts and 1 volt are preferred, and the resistor magnitudes would be changed appropriately.

Capacitor 28 is provided as a slew rate control; it prevents sharp transitions as conductor L1 is pulsed so that ringing and harmonics on the line are minimized. Conductors L1 and L2, which typically are run through an entire building, constitute a big antenna and ringing in the line could radiate energy in violation of FCC Rules. Resistor 30 has a value of 7.68 kilohms and capacitor 28 has a value of 2.2 nF, the two comonents together preventing ringing. Capacitor 26 has a magnitude of 0.1 uF, and its purpose is to prevent short transients from shutting down the regulator as a result of current limiting.

Resistor 44 which terminates the other end of the loop has a magnitude of 2 ohms. Together with resistor 22 which has a magnitude of only 1 ohm, the effective impedance of the voltage source which is placed across all of the identification modules is only about 3 ohms. The reason for this low value is that the two conductors with the interconnected identification modules constitute an antenna loop and the magnitude of the noise which is picked up by an antenna is a function of its source impedance. By minimizing the noise, smaller changes in loop current during the course of module scanning can be sensed. Also, large transients which can arise from the starting and stopping of motors, etc. could otherwise destroy unprotected identification modules and smoke detectors placed in the line; by reducing the source impedance to only 3 ohms, the burden on each unit connected to the loop is reduced.

Although, as described above, the loop current cannot exceed 700 milliamperes, in practice the maximum current is expected to be 500 milliamperes. Consequently, the maximum potential across resistor 44 is only 1 volt. With amplifier 32 in the line, the potential at the DC input of switch SW1 has a maximum value of 5 volts. Switch SW1 is placed in the position shown in FIG. 1 during the main loop monitoring when there is no scanning of individual identification modules. In such a case the potential applied to conductor L1 remains at 24 volts. Each identification module, in the absence of an alarm condition, conducts about 0.5 milliamperes. In the illustrative embodiment of the invention, in which up to about 62 identification modules may be connected in the line, 31 milliamperes may flow in the loop, giving rise to a DC potential at the input of the analog-to-digital converter of (31 milliamperes)(2 ohms)(5), or 310 millivolts. The system is designed to detect a change in the number of modules in alarm conditions. Each energized alarm causes 8 milliamperes to flow through the loop, not 0.5 milliamperes. Thus if all 62 alarms are on, 496 milliamperes will flow through the loop. The potential across 2-ohm resistor 44 will be 992 millivolts, and the gain introduced by amplifier 32 results in (992 millivolts)(5) or 4.96 volts to be applied to the input of analog-to-digital converter 16. A gain of 5 is selected for amplifier 32 precisely because for the analog-to-digital converter used in the illustrative embodiment of the invention, the full-scale input should be held to 5 volts.

During the scanning, the current which flows through the loop depends upon the number of alarm conditions which exist. The current does not change at all if an addressed identification module is not present, or does not respond if it is present. Otherwise, an interrogated identification module causes an increase in the current of 5 milliamperes if its associated alarm is off, and an increase of 11 milliamperes if its associated alarm is on. Just prior to the taking of a reading, switch SW2 is closed. This allows capacitor 36 to fully charge to the DC level being extended to the input of converter 16 while switch SW1 is in the DC position. Thereafter, switch SW2 opens, and then switch SW1 switches to the AC position. The voltage level at the input of the converter is thus zero. The reason for doing this is that in order to sense the response of an identification module when it is interrogated, what is desired is as large a change as possible at the input to the converter. The prior charging of capacitor 36 blocks any DC component whose magnitude necessarily depends upon the number of alarm conditions. Following the interrogation of a specific module, the potential at the AC input to switch SW1 will remain zero if the module in question is missing altogether or for one reason or another cannot respond, or there will be an intermediate rise in potential to represent a no-alarm condition or a larger rise in potential to represent an alarm condition. The rise in current in the line is either 5 milliamperes or 11 milliamperes. This is reflected as an increase of at most 110 millivolts at the output of amplifier 32. After amplificaiton by amplifier 34, the maximum increase is 3.4 volts. (It is assumed that the maximum AC current rise will be about 15 milliamperes even if an identification module does not function perfectly. The reason for amplifier 34 having a gain of 31 is that a current increase of 15 milliamperes will give rise to a voltage swing at the input of the converter of 4.65 volts, close to the maximum of 5 volts.)

The waveforms in FIG. 2 reflect the various conditions which can arise on the line, and the waveforms will be described with reference to the events controlled by the system of FIG. 1. With the microprocessor causing a 24-volt potential to be applied across all of the identification modules, it is assumed that a quiescent current of 10 milliamperes flows in conductors L1 and L2. Typically, this might be the current when there are twenty identification modules and associated smoke detectors connected in the line. Switch SW1 is in the position shown in FIG. 1, and as long as there is no significant change in DC potential at the input of analog-to-digital converter 16, all that the system may do is to continue to monitor the DC potential. Should at least one alarm condition exist, the associated identification module is designed to cause its current contribution to increase from 0.5 milliampere to 8 milliamperes. This is reflected as a 75 millivolt increase in the DC potential at the input of converter 16. The microprocessor looks for an increase in the DC potential of at least 50 millivolts before determining that there is an alarm condition.

The left part of FIG. 2 shows how the line voltage is caused to drop from 24 volts to 19 volts and to remain at the lower level for 0.3 milliseconds between queries. When the line voltage rises it clocks successive identification modules, as described in our above-identified applications. Each time that the line voltage dips, there is a corresponding dip in the line current, as shown in FIG. 2.

Any interrogated identification module responds shortly after the clock pulse identifying it appears on the line. As long as there is no alarm condition but the module recognizes its address, it applies a 5-milliampere current increment on the line, the "AC answer." Such is the case for module number 1 in FIG. 2. In the case of a missing module, there is no response and the loop current remains at the quiescent level. It requires 1.6 milliseconds to poll any module, but the answer is represented in the shorter duration interval during which the 5-milliampere increment may appear on the line. In the illustrative embodiment of the invention, the microprocessor performs five A/D conversions during this interval and it averages the results. The average is considered to be the AC answer; the averaging technique reduces the incidence of false answers due to noise. If any reading is different from the average by more than a specified amount, it is an indication of the presence of excessive noise. The answer is stored by the microprocessor and processed in any standard way, the subsequent processing not comprising a part of the present invention. The present invention is designed to provide the microprocessor with identifications of the modules which are associated with alarm or normal conditions.

At the end of any complete scan (and before the first), the line voltage is held at the 19-volt level for 2 milliseconds. This reset interval allows all of the identification modules to synchronize to the start of a new scan. The master reset, during which the line voltage drops to zero, is used only when it is necessary to unlock a module rather than to reset it because it requires more time to fully discharge the bus and because the master reset removes power from peripheral equipment that is powered by the bus.

It is assumed in FIG. 2 that some time after the start of a new scan (or during DC monitoring) an alarm condition arose and that the loop current increased by 8 milliamperes. (Although an increase of 7.5 milliamperes was described above, it is to be understood that the exact amount depends on many variables such as loop impedance.) The increase in the current level, reflected at the DC input of converter 16 on FIG. 1, is sensed while the voltage between conductors L1 and L2 remains at 24 volts. Assuming that it was module number 1 which represents the alarm condition, when it is polled it will cause an increase in the line current of 11 milliamperes, not 5 milliamperes. The total instantaneous current (with a quiescent current of 10 milliamperes) will thus be 29 milliamperes. When any module is polled, switch SW1 connects the A/D converter to the AC circuit so that the AC increment can be sensed. As shown in FIG. 2, a module such as module #2 still causes a 5-milliampere increase when it is polled if it does not represent an alarm condition. The instantaneous magnitude of the current will thus be 23 milliamperes (5 milliamperes superimposed on the quiescent level of 18 milliamperes). Scanning of the modules continues in this fashion until the alarm condition is corrected, at which time a steady 24 volts may be applied again to the line, until there is a rise in the quiescent level to indicate that another alarm condition exists.

Figure 3:
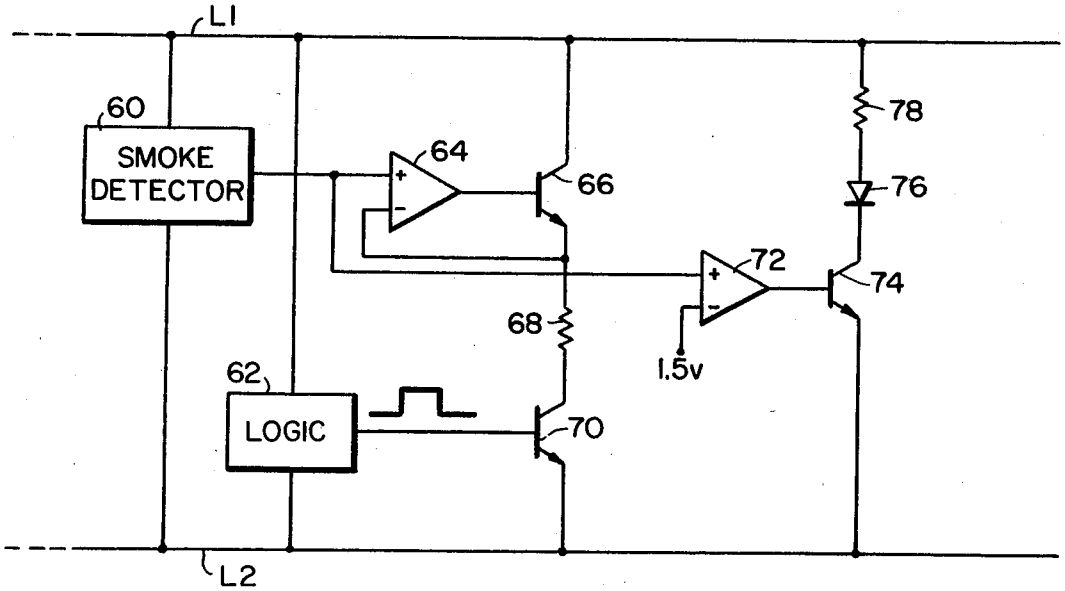
FIG. 3 depicts the circuitry of a particular one of the combined smoke detector/identification module elements connected on the bus.

FIG. 3 represents a smoke detector and an identification module connected across conductors L1 and L2. Logic block 62 is shown only symbolically, it being understood that the details of the logic of a module are contained in our above-identified applications. The line voltage powers smoke detector 60 and also logic circuit 62. This is why each module contributes about 0.5 milliamperes to the total line current even in the absence of an alarm condition.

The output of the smoke detector is applied to the plus input of difference amplifier 72. It is assumed that the output of the smoke detector rises to above 1.5 volts in the case of an alarm condition. The minus input of amplifier 72 is connected to a 1.5-volt source of potential in the identification module. When an alarm condition exists, the output of amplifier 72 goes high and transistor 74 conducts. The current which flows through resistor 78 and light emitting diode 76 causes a rise in the total current of about 8 milliamperes so that the microprocessor can sense the presence of an alarm condition. The light emitting diode provides a visual indication of which smoke detector has operated.

During the scanning, logic circuit 62 pulses transistor 70 when it recognizes its respective address. Amplifier 64 and transistor 66 serve as a voltage-to-current converter; the potential at the output of the smoke detector is reflected at the junction of the emitter of the transistor and resistor 68. The increased current which flows in the line, the "AC answer," is directly proportional to the voltage output of the smoke detector. Although the waveforms of FIG. 2 show AC answers of 5 milliamperes or 11 milliamperes, these are only typical low and high values. The dividing line between alarm and no-alarm conditions is typically represented by a current of 8 milliamperes. An important feature of the arrangement is that the AC answer is an analog level which actually reflects information about the state of the smoke detectors. A lack of change in the current is indicative of no activity at all. Levels of current higher than normal, but less than an alarm condition, may represent dust levels (important for determining when a smoke detector must be replaced); higher levels represent alarm conditions.

It should be noted that the source of current for representing an alarm condition (transistor 74) is not the same as the source of current which represents the level of the alarm output (transistor 66). This is because by using predetermined current changes—controlled by transistor 74 in each module—to represent alarm conditions, the microprocessor can determine how many there are. Since there can be several or even many smoke detectors which give rise to alarm conditions, it would not be possible to determine how many alarm conditions exist if different numbers of different-magnitude currents were summed together and sensed by the analog-to-digital converter. The only way in which the number of alarm conditions can be determined, as long as all of the currents are added together during DC monitoring, is to have each identification module contribute the same DC current increment. It is only when a single identification module is being interrogated that it is desirable for the "AC answer" current increment controlled by the module to have a variable magnitude, a magnitude which is a function of the condition of the respective smoke detector. The measurement of an analog value in this manner can only be accomplished when a single identification module is contributing a variable increment of current to the line.

The system of FIG. 1 includes an integrator, consisting of resistor 38 and capacitor 40, and an amplifier 42 for generating a backup alarm. If the output of amplifier 32 exceeds the level representative of at least one alarm condition, a backup alarm is generated. The reason for doing this is that if the microprocessor malfunctions, not only may it not be possible to determine the source of the alarm signal, but it may not even be possible to determine that an alarm condition exists. The backup alarm at least allows the system to determine that there is an alarm condition somewhere on the loop. The reason for using the integrator comprising resistor 38 and capacitor 40 is to avoid false alarms due to noise.

Thus far it has been said that each identification module causes a variable current increment to flow when it is queried, with the magnitude of the current increment being proportional to the measurement which is to be reported. In the illustrative embodiment of our invention, there is one module which is different from the rest, e.g., module IDMN. This module is not connected to a smoke detector. Instead, when it is queried it always responds with a predetermined current increment which is not within the range applicable to all of the other modules. When the control unit measures the response of a module and senses this predetermined level, it knows that it is module IDMN which has responded. The function of module IDMN is to detect if noise induced on the bus has caused an error in the addressing of the modules. An extra noise-induced pulse may advance all of the modules without the control unit being aware of this. The answers will be shifted so that the data returned will not be attributed to the proper module. Similarly, noise which prevents a clock pulse from being read by a module can shift the answers in the opposite direction. By assigning a predetermined address (preferably the last address) to the module which always responds with a unique predetermined current, it is a simple matter to determine whether the addressing of the modules has been erroneously shifted. The unique AC answer must always appear in its allocated slot or else the microprocessor is made aware that the results of the proceeding scan are not reliable. It is possible that an AC answer which is equal to the predetermined level really resulted from one of the "real" alarm units responding simultaneously with some noise appearing on the line. To prevent an error from such an event, the microprocessor can generate still an additional clock pulse at the end of the sequence, a clock pulse which in fact does not clock any module since the last one should have responded. If an answer is actually received, the microprocessor is made aware that there has been an error.

Especially in the case of high security and fire alarms, it is preferable to have continuous scanning. In such a case, consideration must be given to the time which may elapse before an alarm condition is detected. Consider a system in which there are ten loops, each with 62 modules. Assume further that each loop is scanned twice for verification purposes, and that it requires about 100 milliseconds per loop for the necessary computations. Given that if requires 1.6 milliseconds for a single query, it takes about 300 milliseconds to scan each loop. With ten loops scanned sequentially, it may take as long as 3 seconds to sense an alarm condition. To shorten the response time, a DC reading of all ten loops may be taken before proceeding with the scanning of the next loop. If any DC reading shows that there is an alarm condition on the respective loop, that loop may be scanned next to identify the module or modules which are giving rise to the condition.

Although the invention has been described with reference to a particular embodiment, it is to be understood that this embodiment is merely illustrative of the application of the principles of the invention. Numerous modifications may be made therein and other arrangements may be divised without departing from the spirit and scope of the invention.

We claim:

1. A parallel bus alarm system comprising a bus; a plurality of alarm means connected in parallel across said bus; and control means for causing a DC quiescent current to flow in said bus and for pulsing the potential across said bus to extend addressing signals to said alarm means; each of said alarm means including means for changing said DC quiescent current upon the occurrence of an alarm condition, and means responsive to addressing of the alarm means for controlling the current flowing in said bus to change by a variable increment whose magnitude is a function of an associated analog measurement to be reported; said control means including means for detecting a change in said DC quiescent current to determine the occurrence of at least one alarm condition, and means responsive to subsequent addressing of said alarm means for measuring the current in said bus so as to ascertain the magnitude of the current change controlled by an addressed alarm means.

2. A parallel bus alarm system in accordance with claim 1 wherein said control means has a source impedance in the order of several ohms.

3. A parallel bus alarm system in accordance with claim 1 wherein each of said alarm means includes means for controlling a predetermined current change in said DC quiescent current responsive to the occurrence of an alarm condition.

4. A parallel bus alarm system in accordance with claim 1 wherein said control means includes a microprocessor, and means whose operation is independent of said addressing for generating an alarm signal responsive to a sufficient change taking place in said DC quiescent current.

5. A parallel bus alarm system in accordance with claim 1 further including additional means connected across said bus responsive to a predetermined addressing signal for controlling a fixed current to flow in said bus, said fixed current being at a level outside the normal response range of said plurality of alarm means, said additional means serving to verify that addressing signals have been received correctly.

6. A parallel bus alarm system in accordance with claim 1 wherein the controlling means in each of said alarm means controls said current change in said bus while said control means applies a potential across said bus.

7. A parallel bus alarm system comprising a bus; a plurality of alarm means connected in parallel across said bus; and control means for causing a DC quiescent current to flow in said bus and for pulsing the potential across said bus to extend addressing signals to said alarm means; each of said alarm means including means responsive to addressing of the alarm means for controlling the current flowing in said bus to change by a variable increment whose magnitude is a function of an associated analog measurement to be reported; said control means including means for forming an analog representation of a change in the current flowing in said bus responsive to addressing of an alarm means, and means for measuring said analog representation to ascertain the magnitude of the current change controlled by the addressed alarm means.

8. A parallel bus alarm system in accordance with claim 7 further including additional means connected across said bus responsive to a predetermined addressing signal for controlling a fixed current to flow in said bus, said fixed current being at a level outside the normal response range of said plurality of alarm means, said additional means serving to verify that addressing signals have been received correctly.

9. A parallel bus alarm system comprising a bus; a plurality of alarm means connected in parallel across said bus; control means for causing a DC quiescent current to flow in said bus and for pulsing the potential across said bus to extend addressing signals to said alarm means; each of said alarm means including means responsive to addressing of the alarm means for controlling the current flowing in said bus to change by a variable increment whose magnitude is a function of an associated analog measurement to be reported; said control means including means for measuring a current change in said bus so as to ascertain the magnitude of the current change controlled by an addressed alarm means; and additional means connected across said bus responsive to a predetermined addressing signal for controlling a fixed current to flow in said bus, said fixed current being at a level outside the normal response range of said plurality of alarm means, said additional means serving to verify that addressing signals have been received correctly.

* * * * *